US006590323B1

(12) United States Patent
Stekelenburg

(10) Patent No.: US 6,590,323 B1
(45) Date of Patent: Jul. 8, 2003

(54) PHOTO DIODE LAMP

(75) Inventor: Albert Stekelenburg, Taipei (TW)

(73) Assignee: All-Time Inc., Taipei (TW)

( * ) Notice: Subject to any disclaimer, the term of this patent is extended or adjusted under 35 U.S.C. 154(b) by 183 days.

(21) Appl. No.: 09/619,533

(22) Filed: Jul. 19, 2000

(51) Int. Cl.[7] ..... H01J 5/48

(52) U.S. Cl. ..... 313/318.01; 313/318.04; 362/310; 362/362; 315/74; 315/225

(58) Field of Search ..... 313/318.01, 318.03, 313/318.04, 318.11, 318.12, 113; 362/257, 260, 296, 310, 341, 362; 315/56, 171, 74, 225, 291, 307, 313, 349

(56) References Cited

U.S. PATENT DOCUMENTS 5,465,025 A * 11/1995 Hendricjson ..... 313/318.1 X
5,546,291 A * 8/1996 Simes ..... 313/318.01 X
6,005,337 A * 12/1999 Papp et al. ..... 313/318.01

* cited by examiner

*Primary Examiner*—Ashok Patel
(74) *Attorney, Agent, or Firm*—Troxell Law Office PLLC

(57) ABSTRACT

A photo diode lamp includes lamp head, receiving body, outer shell, cover and photo sensor. There are projections and indents provided on the inner circumference of the receiving body, which receives base and circuit block. The lamp-tube is fixed on the base, its circumference provides screw thread and wire opening. The photo sensor is provided from the end of the wire, the respective projections are provided at lower end of its screw thread. The base of the circuit block is the circuit of the energy-saving type lamps and lanterns, the photocell is provided thereon through an IC. The end with larger diameter of the outer shell provides inner screw thread. Between the outer shell and the cover is clipping connection. The circuit is controlled by means of photo sensor responding to the brightness of outer circumference the lamps and lanterns can be automatically in switch-on/switch-off state.

5 Claims, 4 Drawing Sheets

PHOTO DIODE LAMP

FIELD OF THE INVENTION

The present invention relates to a photo diode lamp, i.e., a structure for lamps and lanterns that can respond to external brightness and have an automatic controlling switch-on/switch-off.

BACKGROUND OF THE INVENTION

Energy-saving lamps and lanterns are adapted for long-time illumination. Such lamps are damageable and need a cover for protection. Lamps and lanterns with a photo sensor which responds to the brightness of the external environment and acts as an automatic controlling switch-on/switch-off, are prior art. However, when both components are to be integrated, the photo sensor is to be installed on the outer shell of the energy-saving type lamps and lanterns. There is no such product like this in the market, because the energy-saving lamp and the lanterns with photo sensors are not compatible. In order to make them compatible, the circuit technology and the assembly must be improved, but it is important that which has a significant energy-saving effect.

SUMMARY OF THE INVENTION

The object of the present invention is to provide a photo diode lamp, for energy-saving lamps and lanterns that have a function of automatic controlling switch-on/switch-off by means of providing a simple structure, and thereby which enlarges the scope and range of use.

The technical solution for embodying the above-mentioned object of the present invention is as below: its constitution includes a lamp head, a receiving body, and outer shell, a cover and a photo sensor. Several projections and indents are provided in the inner circumference at the upper side of the receiving body, and a base and a circuit block are received in the receiving body. A lamp-tube is fixed on the base having a screw-thread. A wire opening is provided on its circumference, and a photo sensor including photocell is provided thereon. Several projections are provided in the lower end of the screw-thread on the base, and the circuit block is the energy-saving type lamps and lanterns circuit, with a photocell provided thereon through an IC. The outer shell is in the form of trumpet, its outer circumference at the end with larger diameter provides a fixing hole for the photocell. A part at the end with smaller diameter provides an inner screw-thread. Several transparent holes are provided on the cover which is in the form of a convex arch surface with several clipping members extending from its planar end. Between the receiving body and the base is a clipping connection and between the outer shell and the base is a screw-thread connection. Between the photo sensor and the outer shell is a glue connection and between the outer shell and the cover is a clipping connection.

BRIEF DESCRIPTION OF THE DRAWINGS

The photo diode lamp of the present invention will be now further described in combination with the embodiment shown in the drawings, wherein.

DETAILED DESCRIPTION OF THE PREFERRED EMBODIMENTS

Figure 1:
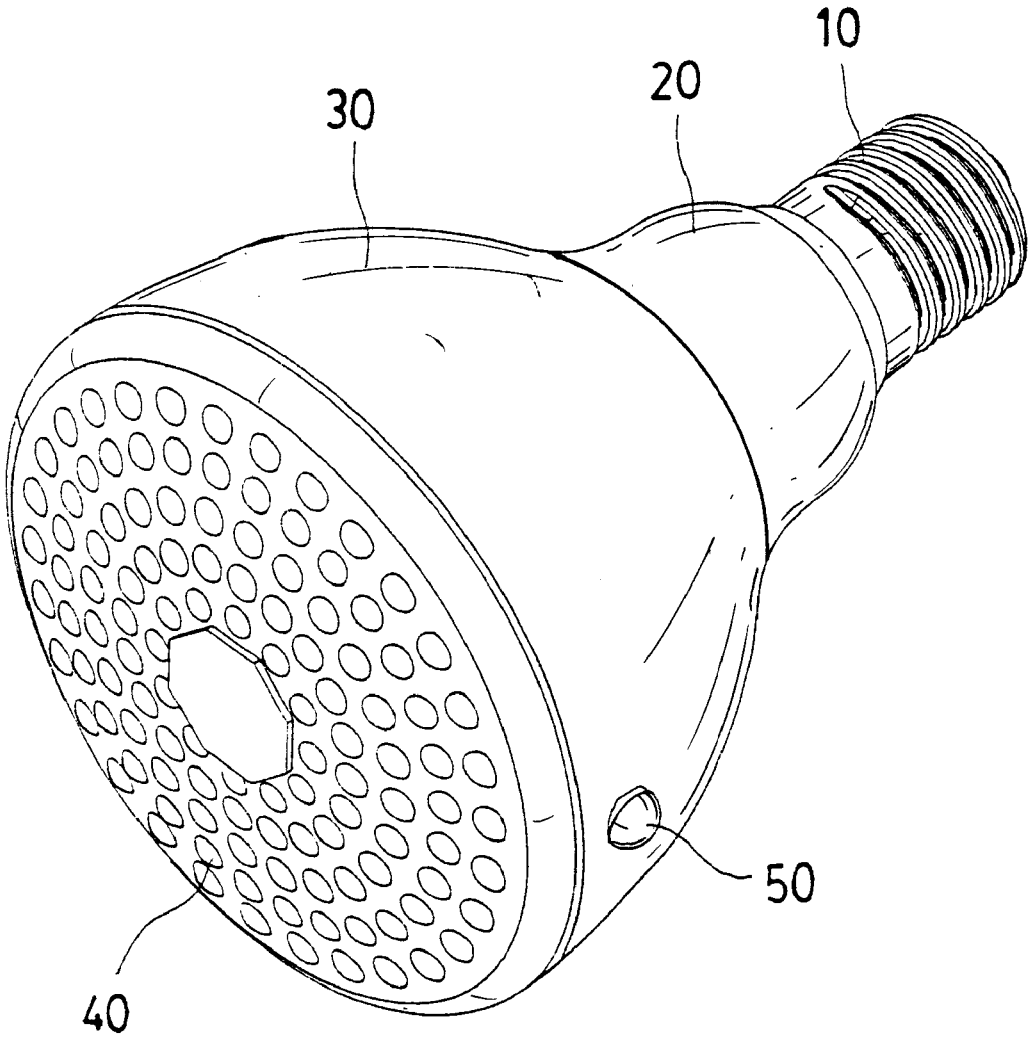
FIG. 1 is a perspective view of the embodiment of the present invention.

As shown in FIG. 1, the present invention includes a lamp head 10, a receiving body 20, an outer shell 30, a cover 40 and a photo sensor 50. The lamp head 10 and the receiving body 20 are as same as the prior structure, the lamp head 10 is installed in the lamp socket (not shown), and the receiving body is used for receiving the inner structure as lamp tube etc.

Figure 2:
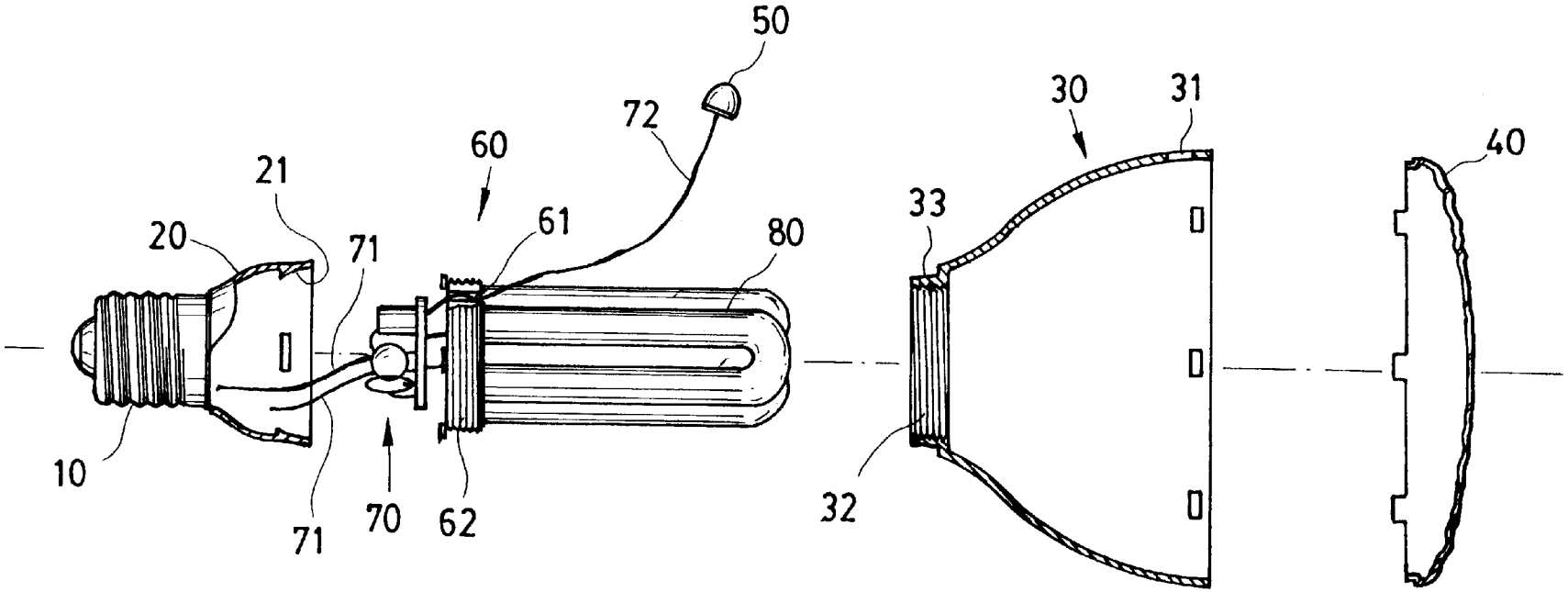
FIG. 2 is an exploded view (sectional view in part) of the embodiment of the present invention.

FIG. 2 is a perspective view in which the constitution of the present invention is further described, and includes the lamp head 10 and the receiving body 20. A base 60, a circuit block 70 and a lamp-tube 80 are provided in the receiving body 20. A hole 31, an inner screw-thread 32 and several fixing slots are provided on the outer shell 30, the hole 31 being used for gluing the photo sensor 50, the fixing slots 34 matching with the clipping members of the cover 40, to connect with each other.

The receiving body 20 receives the base 60 and the circuit block 70 and is used for fixing the wire 71 in the inside of the lamp head 10. The receiving body 20 is fixedly connected with the base 60, and the base 60 is used for fixing the lamp-tube 80. There is an opening 61 provided on the base 60, through which another wire 72 passes. A screw-thread 62 is provided on the circumference of the base 60, and engages the inner screw-thread 32 of the outer shell 30. The outer shell 30 is thus connected to the base 60, and the circumference 33 of the outer shell 30 is tightly connected in the inner circumference 21 of the receiving body 20.

When assembling the present invention, the wire 71 of the circuit block 70 is first welded to the lamp head 10, the wire 72 is passed through the opening 61 and a photo sensor 50 including photocell is provided on wire 72. The base 60 and the lamp-tube 80 are then fixed to the receiving body 21, the outer shell 30 is connected on the base 60, the photo sensor 50 is fixed in the hole 31, the cover 40 is finally connected to the outer shell 30.

Figure 3:
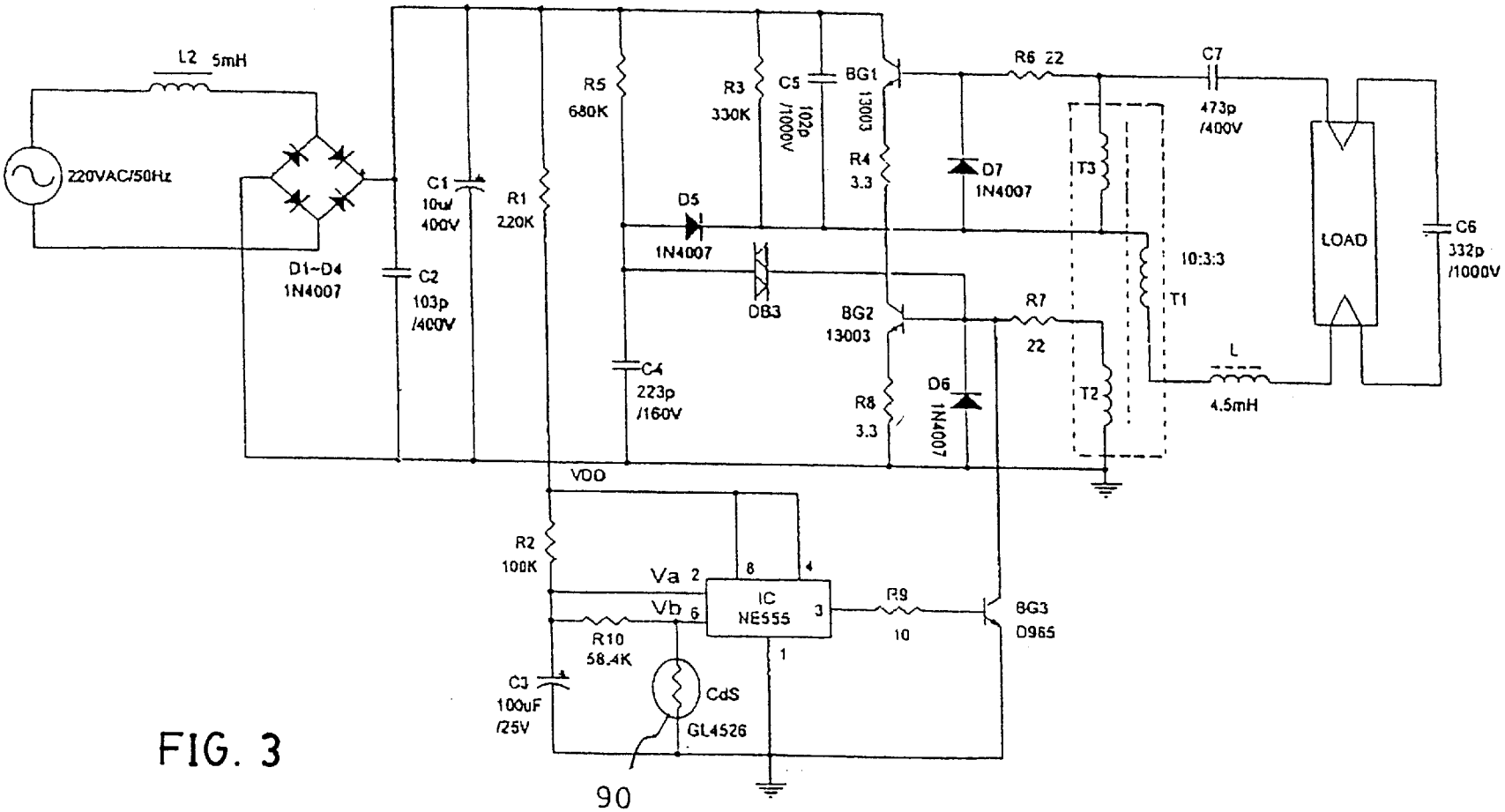
FIG. 3 is a circuit diagram of the present invention.

FIG. 3 shows the circuit diagram of the present invention, in which the most part are the prior circuit of the energy-saving type lamps and lanterns, thereby the principle of its operation will not be described. The main characteristics of the present invention is the lower controlling circuit provided with the photocell 90, IC and photo sensor 50, has the principle of its operation noted below:

1. when the voltage Va at the pin 2 of the IC is lower than the ⅓ VDD, the output of the IC is high voltage;
2. when the voltage Vb at the pin 6 of the IC is higher than the ⅔ VDD, the output of the IC is low voltage;
3. the photocell can change its inner resistance value, which is due to responding to the strength of ambient light;
4. when the light is strengthening, the resistance value of the photocell will be lowered, Va and Vb values are then lowered. When the Va value is lower than ⅓ VDD, the output of IC is low voltage to control the output device, the lamp-tube will be switched off;
5. when the light is weakening, the resistance value of the photocell will increase and Va and Vb values are then rising. When the Vb value is higher than ⅔ VDD, the output of IC is high voltage to control the output device, the lamp-tube will be switched in.

Figure 4:
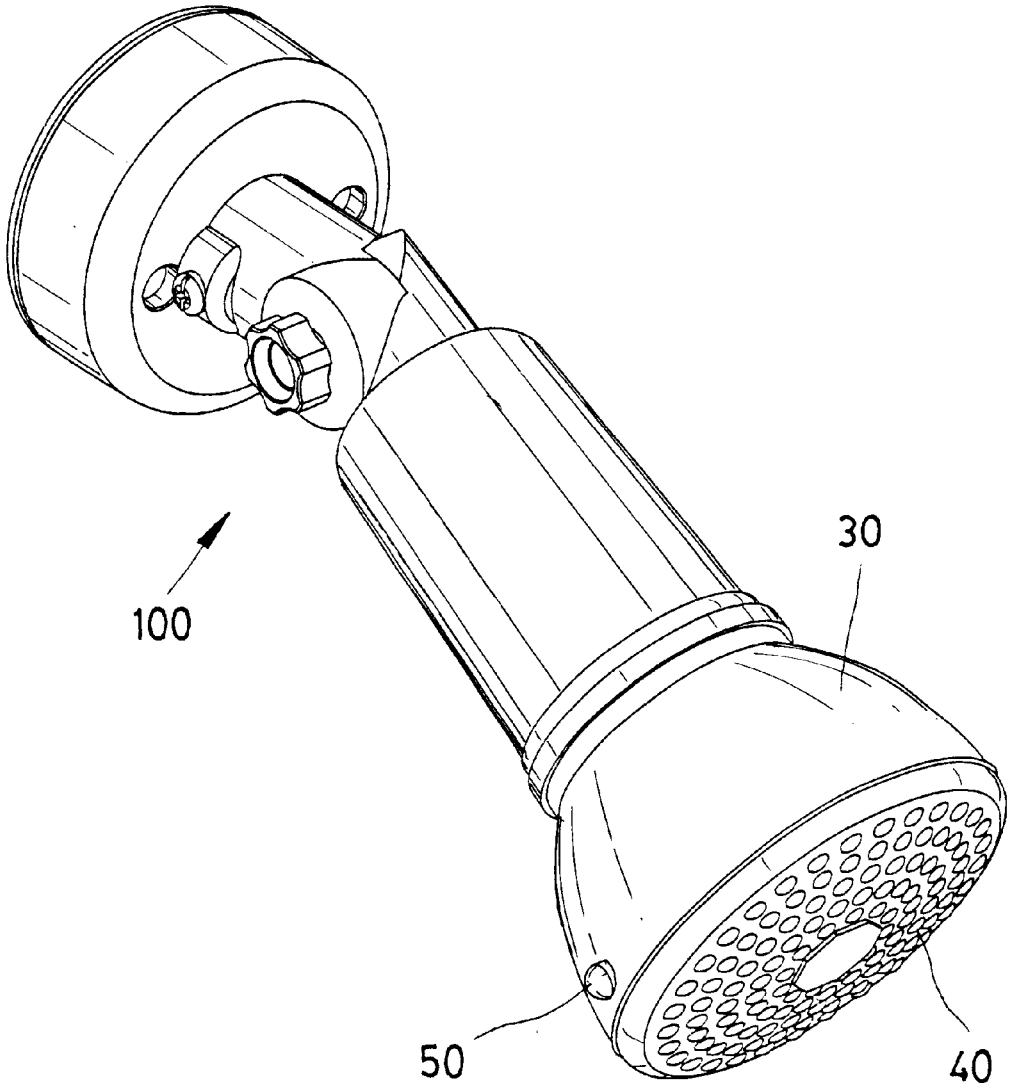
FIG. 4 is a perspective view of the present invention in the using state.

FIG. 4 shows a state of using the present invention, with the photo diode lamp of the present invention installed on the lamp socket 100 having the power supply. When the brightness of the circumference is changed, the resistance value of the photocell 90 which is positioned in the photo sensor 50 is changed, thereby the lamps and lanterns will be switched on/off.

In summary, the photo diode lamp of the present invention is provided with a photo sensor having photocell on the circuit block, which is provided on the fixing hole of the outer shell by means of the wire passing through the base, and the transparent cover is clipped at the front of the outer shell. Its circuit is controlled by means of the photo sensor responding to the brightness of the light at the outside of the lamp. Thus, the lamps and lanterns may be switched-on/switched-off. The structure of the above-mentioned lamps and lanterns are simple and easily embodied, which is indeed an important improvement in this technical field.

It cannot be denied that such energy-saving type lamps and lanterns with photocell are adapted for long-time illumination in all public space, such as hotels, hospitals, railway and bus stations, large scale parking area etc and with which the energy-saving is significant.

The disclosure of the present invention is one of the preferred embodiments, the partial variations or amendments from the technical thought of the present invention and are easily inferred by the technician knowing this field, are not apart from the scope and range of the claimed patent for the present invention.

What is claimed is:

1. A photo diode lamp comprising:

a) a lamp head having a threaded portion configured to engage an electrical lamp socket;

b) a receiving body on the lamp base;

c) a base located in the receiving body, the base including a circuit block wired to the lamp head, and a lamp tube;

d) an outer shell attached to the base and enclosing the lamp tube, the outer shell including a cover, and a hole in a side of the outer shell; and, e) a photo sensor mounted in the hole in the outer shell so as to be exposed to ambient light, the photo sensor wired to the circuit block so as to sense ambient light, thereby causing the lamp tube to be switched on or off.

2. The photo diode lamp of claim 1 wherein the circuit block includes an integrated circuit (IC) and a photocell.

3. The photo diode lamp of claim 1 wherein the outer shell is threadingly attached to the base.

4. The photo diode lamp of claim 1 wherein the cover is clipped onto the outer shell.

5. The photo diode lamp of claim 1 wherein an outer surface of the outer shell is connected to an inner surface of the receiving body.

* * * * *